US010695888B2

(12) United States Patent
Harte et al.

(10) Patent No.: US 10,695,888 B2
(45) Date of Patent: Jun. 30, 2020

(54) ELASTIC BIASING ELEMENT AND ENCODER ARRANGEMENT FOR PRECISE CONTROL OF FORCE OR TORQUE

(71) Applicants: Sunnen Products Company, St. Louis, MO (US); John Harte, St. Peters, MO (US); Daniel R. Cloutier, Clive, IA (US); Mark Maichel, St. Louis, MO (US)

(72) Inventors: John Harte, St. Peters, MO (US); Daniel R. Cloutier, Clive, IA (US); Mark Maichel, St. Louis, MO (US)

(73) Assignee: Sunnen Products Company, St. Louis, MO (US)

( * ) Notice: Subject to any disclaimer, the term of this patent is extended or adjusted under 35 U.S.C. 154(b) by 161 days.

(21) Appl. No.: 15/508,711

(22) PCT Filed: Sep. 4, 2015

(86) PCT No.: PCT/US2015/048710
§ 371 (c)(1),
(2) Date: Mar. 3, 2017

(87) PCT Pub. No.: WO2016/037143
PCT Pub. Date: Mar. 10, 2016

(65) Prior Publication Data

US 2017/0282330 A1 Oct. 5, 2017

Related U.S. Application Data

(60) Provisional application No. 62/045,872, filed on Sep. 4, 2014.

(51) Int. Cl.
*B24B 49/16* (2006.01)
*B24B 47/20* (2006.01)
(Continued)

(52) U.S. Cl.
CPC ..... *B24B 49/16* (2013.01); *B24B 33/02* (2013.01); *B24B 33/087* (2013.01); *B24B 47/20* (2013.01)

(58) Field of Classification Search
CPC ..... B24B 49/16; B24B 33/02; B24B 33/087
See application file for complete search history.

(56) References Cited

U.S. PATENT DOCUMENTS 5,095,662 A * 3/1992 Grimm ..... B24B 33/06 451/10
5,269,103 A * 12/1993 Nagel ..... B24B 33/087 451/27

(Continued)

FOREIGN PATENT DOCUMENTS

DE 3537172 A1 * 4/1987 ..... B24B 33/087

*Primary Examiner* — Joseph J Hail
*Assistant Examiner* — J Stephen Taylor
(74) *Attorney, Agent, or Firm* — Matthews Edwards LLC

(57) ABSTRACT

An apparatus, system, and method using an elastic biasing element in combination with an encoder arrangement for precise control of force or torque applied to a moving object, is applied for controlling a feed force applied to an abrasive element of a bore finishing tool, to respond to changes in the feed force such as can arise from contact with a workpiece bore surface and variations therein, such as tapers, hourglass shapes, barrel shapes, and the like. The elastic biasing element can include a single or multiple springs in one or more sets, and the feed force can be selected to have a constant value or vary as a function of time, position, or other variables or conditions.

20 Claims, 8 Drawing Sheets

(51) Int. Cl.

| | |
|---|---|
| ***B24B 33/02*** | (2006.01) |
| ***B24B 33/08*** | (2006.01) |

(56) References Cited

U.S. PATENT DOCUMENTS

| | | | |
|---|---|---|---|
| 5,433,656 | A | 7/1995 | Cloutier |
| 7,575,502 | B2 | 8/2009 | Cloutier et al. |
| 8,277,280 | B2 | 10/2012 | Cloutier |
| 2007/0298685 | A1 | 12/2007 | Cloutier et al. |
| 2013/0178138 | A1 | 7/2013 | Cloutier |

* cited by examiner

ELASTIC BIASING ELEMENT AND ENCODER ARRANGEMENT FOR PRECISE CONTROL OF FORCE OR TORQUE

This application is submitted under 35 U.S.C. 371 claiming priority to PCT/US2015/48710, filed Sep. 4, 2015, which application claims the benefit of U.S. Provisional Application No. 62/045,872, filed Sep. 4, 2014.

TECHNICAL FIELD

This invention relates generally to an apparatus, system, and method using an elastic biasing element in combination with an encoder arrangement for precise control of force or torque applied to a moving object, and more particularly, for precisely controlling force or torque applied for controlling feed force of a bore finishing tool such as a honing tool.

BACKGROUND ART

PCT/US2015/48710, filed Sep. 4, 2015, and U.S. Provisional Application No. 62/045,872, filed Sep. 4, 2014, are incorporated herein by reference in their entirety.

There are many devices and methods of imparting a force (or torque) to a moving object. In some cases it is beneficial to control that force very precisely and at the same time dynamically monitor the position of the object, again with some degree of precision. Various servomotors, servo-controlled fluid systems, motor/encoder combinations can accomplish that task suitably for many applications. However, if the speed of motion is slow, or if the controlled force needs to be selectable from a relatively low value to a much larger value, then conventional systems can fail to hold the desired output force to a precise or consistent value. Also, some systems may be moving sufficiently fast but are subject to encountering sudden or widely varying resistance, such when the object impacts some fixed object. In those applications conventional systems such as those mentioned above, can lack the fast response time required to prevent a spike in the level of force imparted.

Also the nature of motion control systems is that changes to motor position cannot be instantaneous, and although properly tuned, there can still be overshoot and undershoot in the resulting applied force or torque which in a purely rigid system would result in brief fluctuations in the force or torque delivered to the moving object.

In the context of bore finishing, such as, but not limited to, honing, a finishing tool assembly will be rotated within a bore or other cavity of a workpiece, about an axis and reciprocatingly moved or stroked along the axis, while a feed force is applied radially or laterally to an abrasive element or elements, e.g., honing stone or stones, for abrading material from the surface of the workpiece within the bore or cavity. This feed force is applied by a feed mechanism or system which typically includes one or more feed elements within the tool, e.g., wedge or wedges of the finishing tool assembly. The feed force is applied by an output rod of the feed mechanism axially against the wedge or wedges, which translate the axial force into radial outward force applied to the honing stone or stones. The applied force is typically precise, but can be intentionally varied as required for imparting certain precise characteristics to the surface of the workpiece bore or cavity. As an example, the workpiece bore or cavity may originally have a shape such as a barrel, hourglass or taper, and it may be sought to remove that original shape and impart a very precise cylindrical shape to the surface. The original bore may also skew, or have other malformations that are required to be removed by the honing or other bore finishing operation. Conversely, it may be desired to impart a precise taper, hourglass, or barrel shape. In both instances, it may be necessary to precisely vary the feed force applied to the honing stone or stones, and also varying the stroking action, to abrade the surface of the bore or cavity in a manner to achieve the sought after characteristics. The feed force can thus desirably be sought to be a precisely controlled constant force, or a precisely controlled variable force, e.g., controlled to virtually any required function or algorithm, for instance, based on time, position, or other variables that are monitored by the control system controlling operation of the feed mechanism.

Generally, in a bore finishing machine, feed force is generated using drive apparatus of the feed system, such as a servomotor, controlled by a motion control system capable of responding to externally measured or computed digital signals. Some mechanism is used to convert the motor rotation to linear motion. As examples, the mechanism can be a ball screw and ball nut, a rack and pinion, or any other device capable of converting rotary motion to linear motion. The ball nut, moving linearly, pushes against a spring which in turn bears against the output rod. An alternative is a linear actuator, cylinder, or the like, can be used.

Reference Cloutier et al., U.S. Pat. No. 7,575,502, entitled method of operating honing feed system having full control of feed force, rate, and position; and Cloutier et al., U.S. Pat. No. 8,277,280, entitled honing feed system and method employing rapid tool advancement and feed force signal conditioning, which discuss various feed control principles and apparatus, the disclosures of which are incorporated herein by reference in their entireties. While these system and methods provide satisfactory performance, they are complex and costly to implement.

A problem that can occur when operating less complex and costly feed systems when attempting to apply precise feed force, whether constant or varied in a controlled manner, is that as the tool encounters obstacles, irregularities, bore size variances, such as a narrower bore section, surface skew, or the like, rigidity of the feed mechanism can cause a feed force spike if the feed force is not sufficiently quickly adjusted or attenuated. This is problematic as feed and motion control systems always require some amount of time to react to sudden changes and in that amount of time the force will continue to increase which can result in variations, longer process times, and other shortcomings or problems.

Also the nature of motion control systems such as feed systems is that changes to motor position cannot be instantaneous, and although properly tuned, there can still be overshoot and undershoot which in a purely rigid system would result in brief fluctuations in the force delivered by the output rod.

Thus what is sought is a manner of force controlled motion, to substantially reduce or eliminate the above referenced problems, with minimal complexity and cost compared to more sophisticated known feed control systems.

SUMMARY OF THE INVENTION

What is disclosed is apparatus, system, and method using an elastic biasing element in combination with an encoder arrangement for precise control of force or torque applied to a moving object, and more particularly, incorporated into a feed control system for bore finishing such as honing, for precisely controlling force or torque, for instance, applied for controlling feed force of a bore finishing tool such as a honing tool, to substantially reduce or eliminate the above referenced problems and shortcomings of known systems, with minimal complexity and cost compared to more sophisticated known systems.

According to a preferred aspect of the invention, a feed system for a feeding and applying a feed force to an abrasive element of a bore finishing tool in a lateral direction relative to an axis of rotation thereof, comprises:

a drive apparatus controllably operable to move a drive element in a first direction and an opposite second direction within a predetermined range;

an elastic biasing element having a first end and a second end, the first end disposed in predetermined relation to the drive element and configured so as to be displaced by the movement thereof to cause the biasing element to elastically store a quantity of energy proportional to the displacement and representative of the feed force, and the second end being disposed in predetermined relation to an output element disposed to move generally axially in cooperation with a feed element of the bore finishing tool to transfer and apply the feed force laterally to the abrasive element and to communicate or transfer changes in the applied feed force from the abrasive element to the second end of the biasing element to cause joint movement or displacement thereof; and a first sensor positioned and operable to determine a value representative of the movement or displacement of the second end of the biasing element or output element and output a signal representative thereof, a second sensor positioned and operable to determine a value representative of the displacement of the first end of the biasing element or position of the drive element and output a signal representative thereof, and a processor connected to the first sensor and to the second sensor to receive the signals outputted thereby and operable to responsively determine a value for the movement of the drive element of the drive apparatus to apply a selected feed force.

According to another preferred aspect, the selected feed force can have a precise constant value. According to other aspects of the invention, the feed force can be controlled to any required function, either based on time, position or other variables that are monitored by the control system.

According to another preferred aspect, the drive apparatus comprises a servomotor or such controlled by a motion control system capable of responding to externally measured or computed digital signals. Some means is used to convert the motor rotation to linear motion. This can be accomplished in a suitable, as a non-limiting example, using a ball screw and ball nut, a rack and pinion, or any other device capable of converting rotary motion to linear motion. The ball nut, moving linearly, pushes against an elastic biasing element, which is preferably, but not limited to, a spring or springs which in turn bear against an output element such as an output rod. According to an optional aspect, the drive apparatus/element can comprise a fluid cylinder such as a hydraulic cylinder, or a linear motor or actuator so that conversion of rotary to linear motion is not required.

As a non-limiting representative example, the bore finishing tool can be a honing tool, wherein the output element is typically a rod configured to drive a feed element of the tool, e.g., a wedge, to translate and apply the feed force laterally to an abrasive element(s) or stone(s), as the tool assembly is rotated and stroked by the honing machine relative to some workpiece that has a bore to be finished.

As other optional aspects of the invention, the elastic biasing element or elements can be linear or nonlinear springs or other elastic components, and combinations of linear and nonlinear springs and springs having different spring constants, as long as their force vs. compression or tension function is known and can be digitally computed.

As another preferred aspect of the invention, the first sensor can be a linear encoder and is considered to be the primary input. This encoder is considered primary because it measures the position of the second end of the biasing element either directly or via measuring the position of the output element, e.g., output rod, and/or other rigid components connected to it. This position may be displayed and/or used for other machine control functions. In the example of the honing machine, the honing cycle can be stopped when the position reaches a value known to correspond to a desired bore size.

As another preferred aspect of the invention, the second sensor can be a secondary linear encoder could be placed directly on the drive element, e.g., ball nut, rack and pinion, etc., (or in that vicinity) to measure its position which is representative of the displacement of the first end of the biasing element. However, servomotors will commonly be equipped with internal rotary encoders so it can be simpler to instead use that encoder as the secondary encoder.

As another preferred aspect of the invention, to control the output force, e.g., feed force, the motion control system will continually sample the outputs of both the primary and secondary encoders or other sensors and compute their differences. This difference is compared to a desired difference which corresponds to a desired net level of force resulting from the overall displacement, e.g., compression of the biasing element or elements. This computed difference then becomes the feedback variable controlling the motion of the drive apparatus. If the difference is too large then the drive apparatus is controllably operated in the direction that will reduce that difference; if the difference is too small then the apparatus is controllably operated in the direction that will increase the difference. In this manner the output element or rod can be moved through a range of motion continually imparting the desired (programmed) level of force.

As an attendant operational advantage of the invention, if the output element encounters sudden resistance (in the honing example, when the stone contacts the workpiece bore) then there will be a force spike at impact. The motion control system always requires some amount of time to react to sudden changes and in that amount of time the force will continue to increase. If the biasing element(s), e.g., spring(s), is/are fairly "soft" (low value of spring constant), then the force will increase only minimally in the brief time that the motion control system can respond to the change in position. Therefore this system can be designed to have a spring(s) with a spring constant(s) that keep those sudden force changes within a very small tolerance band as required by the particular application.

According to a preferred method of the invention for controlling a feed force applied to an abrasive element of a bore finishing tool laterally relative to an axis of rotation of the tool, the following steps are used:

providing a drive apparatus controllably operable to move a drive element in a first direction and an opposite second direction within a predetermined range;

providing an elastic biasing element having a first end and a second end, the first end disposed in predetermined relation to the drive element so as to be displaced by the movement thereof to cause the biasing element to elastically store a quantity of energy proportional to the displacement and representative of the feed force, and the second end being disposed in predetermined relation to an output element disposed to move generally axially in cooperation with a feed element of the bore finishing tool to transfer and apply the feed force laterally to the abrasive element and to move or displace as a function of changes in the applied force; and during rotation of the tool in a bore with the abrasive element in contact with a surface bounding the bore, controlling the drive apparatus to move the drive element as required to variably displace the first end of the biasing element responsive to the movements or displacements of the second end, to apply a predetermined feed force to the abrasive element.

DETAILED DESCRIPTION OF PREFERRED EMBODIMENTS OF THE INVENTION

Figure 1:
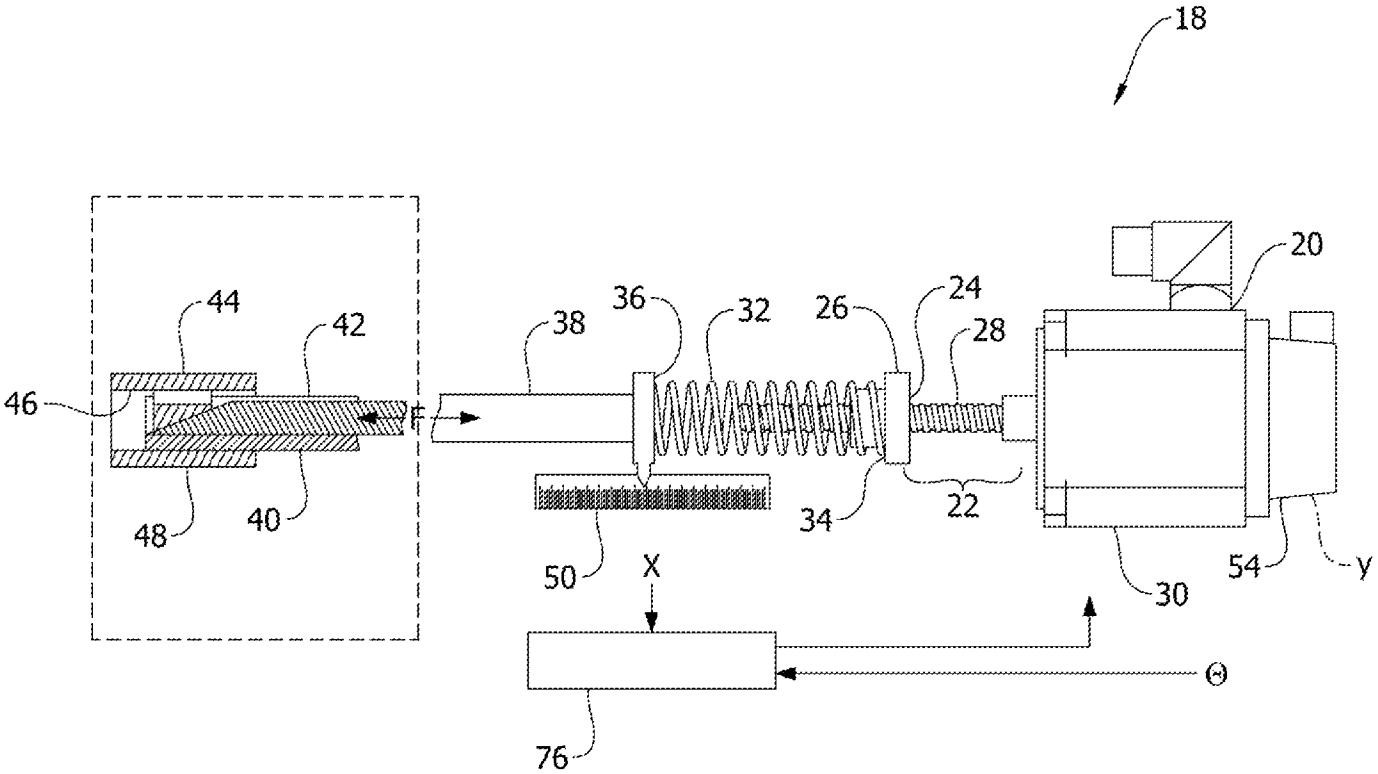
FIG. 1 is a simplified side view of a representative embodiment of a motion control system of the invention, used for controlling feed of a bore finishing tool.

Referring now to the drawings, a bore finishing feed system 18 incorporating an apparatus, system, and method of motion control adapted for imparting a precise feed force to an abrasive element of a tool of a bore finishing tool, is shown. The feed system 18 is operable to control the applied feed force as a constant force, or a force controlled to any required function, either based on time, position or other variables that are monitored by the system, as desired or required for a particular application.

Input motion is accomplished with a drive apparatus 20 such as a servomotor 30 or such, having a drive element 22, and capable of responding to externally measured or computed digital signals. When a rotary servomotor is used, some apparatus to convert the motor rotation to linear motion 24 is required. In this embodiment this is accomplished using a ball screw 26 and a ball nut 28, but it could be a rack and pinion or any other device capable of converting rotary motion to linear motion. The ball nut 28, moving linearly, pushes against a first end 34 of an elastic biasing element 32 which in this embodiment is a spring, and which has a second end 36 that in turn bears against an output element 38, which can comprise for instance, an output rod of the bore finishing or honing machine.

In the bore finishing or honing machine, the output element 38 will drive a wedge 42 of a honing tool 40. The wedge 42 imparts force and motion to an abrasive element or elements 44, such as a honing stone or stones. This honing tool assembly is rotated and stroked by the honing machine (spindle not shown) relative to a workpiece 48 that has a bore surface 46 within a bore to be finished.

The force being delivered by the above described apparatus will cause the elastic biasing element 32 (spring) to compress by an amount that is a function of the force being applied. If x and y represent the linear positions of rigid components connected to ends 34 and 36 of biasing element 32, and if $x_0$ and $y_0$ are some pair of positions where the biasing element 32 is uncompressed, then the force in the element 32 is a function of the differences in these positions:

$$F=f[(y-y_0)-(x-x_0)] \text{ where } F \text{ is the delivered force}$$

For conventional springs, this function is a simple proportional relationship such that $$F=k[(y-y_0)-(x-x_0)] \text{ where } k \text{ is the spring constant}$$

However, nonlinear springs or other elastic components may be used as biasing element 32 as long as their force vs. compression function is known and can be digitally computed.

The position x is measured continually by a primary encoder 50, which here is a linear encoder connected to a process controller 76 of the system for outputting positional signals thereto. This encoder 50 is considered primary because it measures the position of the output element 38 and other rigid components connected to it relative to a fixed location such as a frame 52 of the machine on which the system is used. It is often useful or necessary to display this position or use it for other control functions. In the example of the honing machine, the honing cycle can be stopped when the position x reaches a value known to correspond to a desired bore size.

A secondary encoder 54 also connected to controller 76 for outputting positional signals thereto can be placed directly on the ball nut 28 (or in that vicinity) to measure the position y. However servomotors will commonly be equipped with internal rotary encoders so it becomes simpler to instead use that encoder as the secondary encoder 54. A mathematical conversion will be necessary:

$$y=r\theta$$

where r is the ratio of an increment of linear motion to the corresponding increment of rotation as determined by the specific parameter of the ball screw or other rotary to linear conversion device. θ represents the number of increments of rotary motion (counts).

To control the output force, the system 18 will continually sample both the primary and secondary encoders 50 and 54 and compute their differences. This difference is compared to a desired difference which, by the functions shown above, corresponds to a desired level of feed force. This computed difference then becomes the feedback variable controlling the motion of the drive apparatus 20. If the difference is too large then the drive apparatus 20 is operated in the direction that will reduce that difference; if the difference is too small then the apparatus 20 is operated in the direction that will increase the difference.

In this manner the output element 38 can be moved through a range of motion continually imparting the desired (programmed) level of feed force.

The use of an elastic element (such as a spring) as opposed to more rigid connections serves to maintain the constancy of the delivered feed force as follows.

If the output element 38 encounters sudden resistance (in the honing example, when the abrasive element or honing stone contacts the workpiece bore surface 46) then there will be a force spike at impact. The system 18 always requires some amount of time to react to sudden changes and in that amount of time the force will continue to increase. If the elastic biasing element 32 is fairly "soft" (low value of k), then the force will increase only minimally in the brief time that the system can respond to the change in position x. Therefore this system can be designed to have a spring with a spring constant that keeps those sudden force changes within a very small tolerance band as required by the particular application.

In operation, during rotation of the tool 40 in a bore with the abrasive element 44 in contact with a surface 46 bounding the bore, drive apparatus 20 can be automatically controlled by controller 76 to move the drive element 22 as required to variably displace the first end 34 of the biasing element 32 responsive to changes in the applied feed force as represented by displacements of the second end 36, to apply a predetermined feed force to the abrasive element 44. Thus it should be apparent that the system can efficiently and quickly respond to variations in the applied feed force resulting from bore diameter variations and the like, including during concurrent rapid stroking actions of the tool.

It is known that due to the nature of motion control systems, changes to motor or other driver position cannot be instantaneous, and although properly tuned, there can still be overshoot and undershoot which in a purely rigid system would result in brief fluctuations in the force delivered by the output element. Having an elastic member in the drive train as afforded by the present invention allows errors in servomotor and other driver position to cause only very minimal errors in delivered force. Again, the degree of force precision can be designed into the system by proper selection of the spring constant.

Variations

Figure 2:
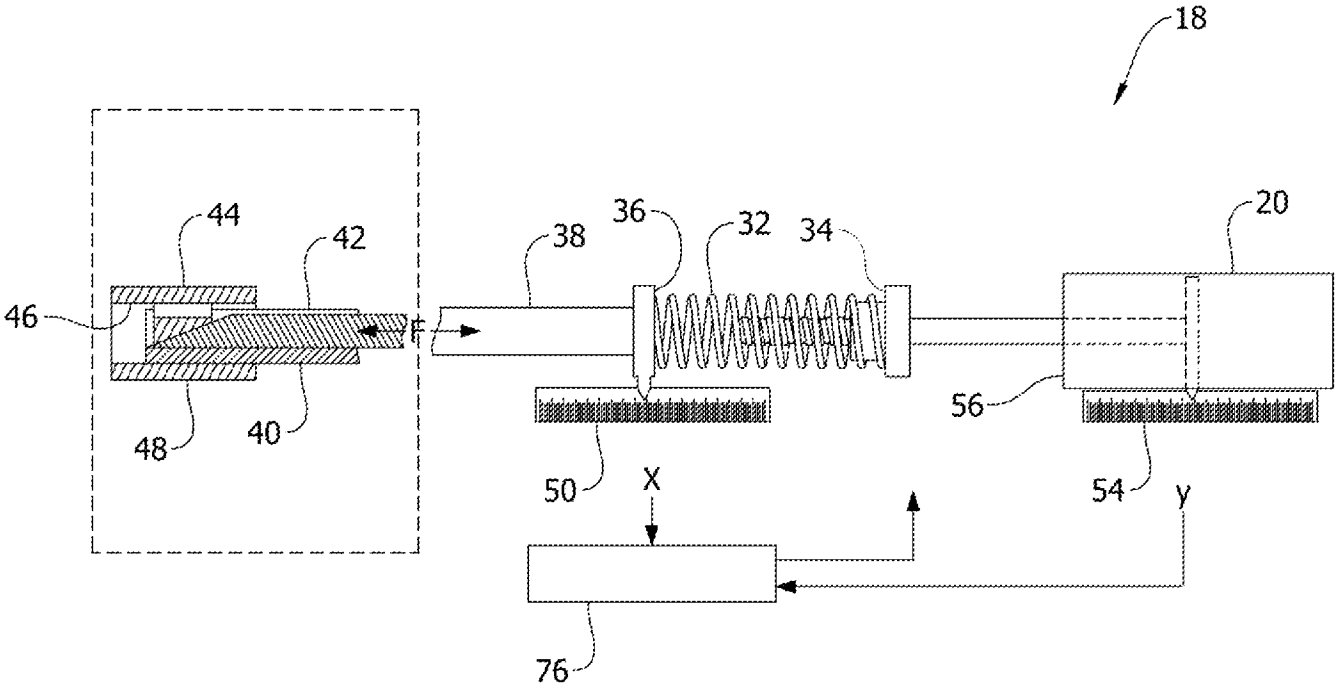
FIG. 2 is a simplified side view of a another embodiment of a motion control system of the invention, used for controlling feed of a bore finishing tool.

FIGS. 1 and 2 show one simple embodiment of the system and apparatus of the invention, but many other variations are envisioned:

As described above, a rotary encoder is not required if the secondary encoder is a linear encoder located near the input to the spring. In such a case, the driver could be a linear driver 56 such as a linear motor or a fluid cylinder such as a hydraulic cylinder controlled by a servo valve, which often can be supplied with embedded linear encoders. This variation is shown in FIG. 2.

The same principle of operation can used to control an output torque. In that case there is no ball screw to convert rotary motion to linear motion and the spring is a torsion spring. The primary encoder then is a rotary encoder. Again the difference between the two rotary encoders represents some level of torque as determined by the spring constant of the torsion spring.

The spring need not be a conventional coil spring. It can be any component that is significantly less rigid than the rest of the drive train.

The spring can be one capable of tension so that a pulling force can be controlled, or both compression and tensions springs may be used in combination to have a system capable of pushing and pulling. Likewise this elastic component may be multiple springs arranged in an assembly so that push and pull forces can be controlled with the same device.

The elastic component may be an assembly of multiple springs with various spring constants, to provide finer force control for lower levels of force than for higher levels of force, thereby keeping the overall length of the device to a minimum. Likewise non-linear springs may be used to achieve the same effect.

Figure 3:
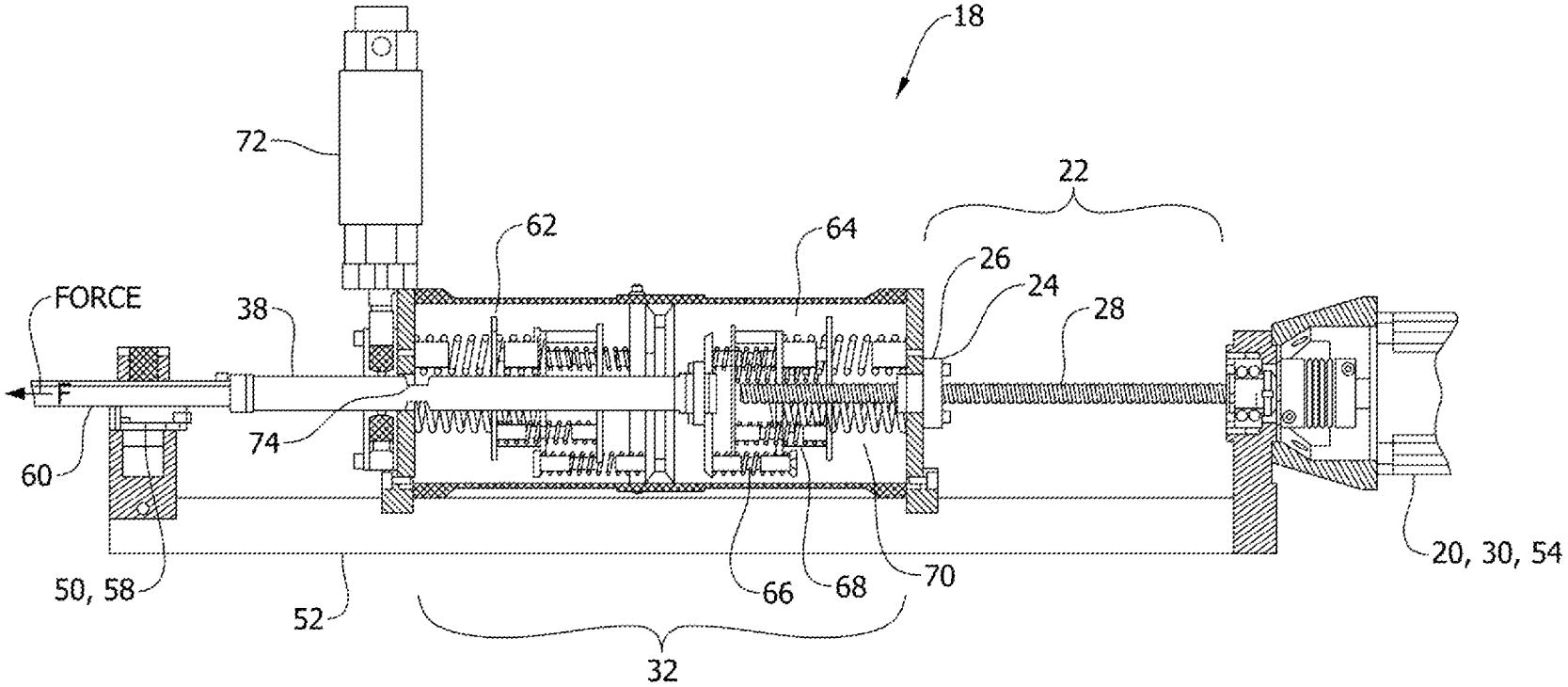
FIG. 3 is a simplified side view of a another embodiment of a motion control system of the invention, used for controlling feed of a bore finishing tool.
Figure 4:
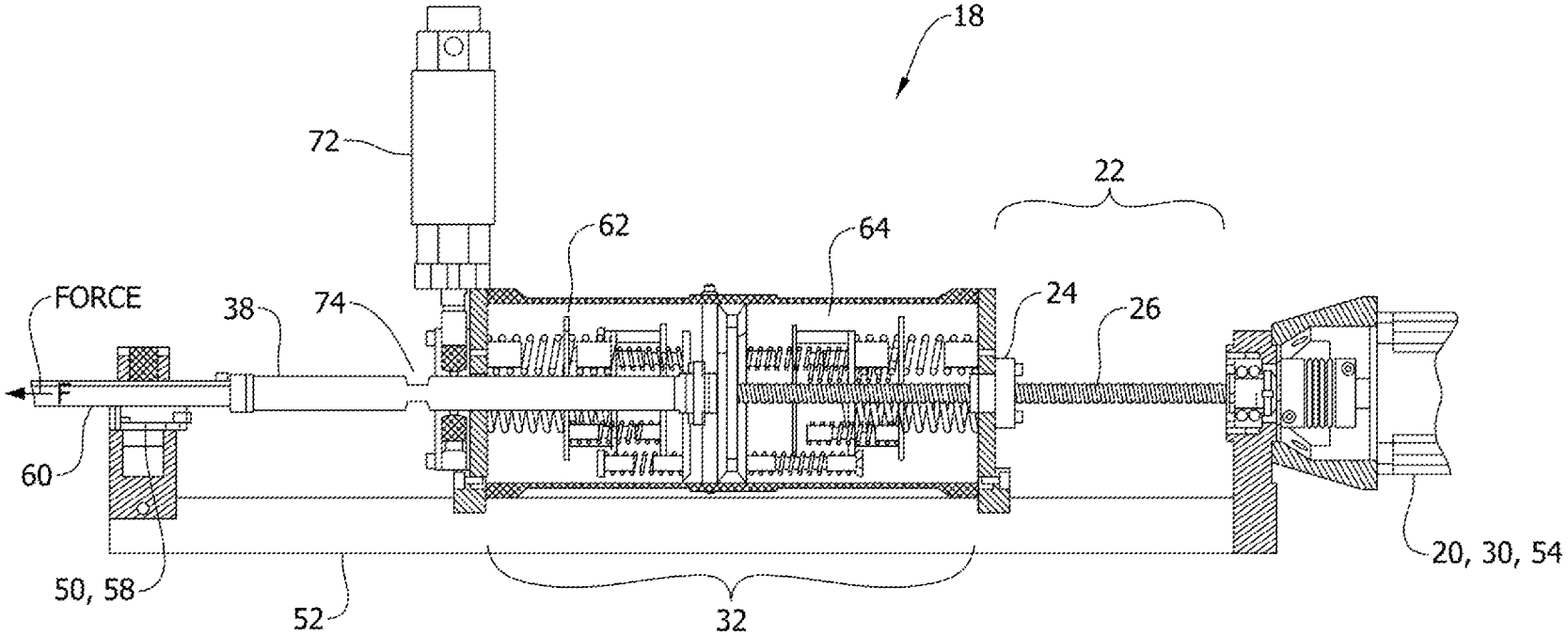
FIG. 4 is another simplified side view of the motion control system of FIG. 3, shown in another operating mode.

These last two variations are employed in one particular embodiment for a honing machine as shown in FIGS. 3 and 4.

In this embodiment, a set of several springs are used as the elastic biasing element 32. Each set is comprised of a subset of springs of various strengths, each subset acting in series, but nested together to optimize the utilization of space. Each subset is comprised of multiple springs in parallel, which allows for achieving the low spring rate (for better control) also in a relatively small space.

Two such spring sets can be arranged in a housing that is pushed or pulled by a ball screw 26 and ball nut 28 and servomotor 30 as previously described. FIG. 3 shows an assembly that is being pushed by the ball screw and motor. By this motion a push-side spring Set 64 is partially compressed to deliver a push force F through a central feed rod that comprises the output element 38 (in connection with the feed element of the tool such as wedge 42 (FIGS. 1 and 2). In this mode the other set of springs is a pull-side set 62 which is relaxed and not used.

FIG. 4 shows an assembly that is being pulled by the ball screw and motor arrangement. By this motion the pull-side spring set 62 is partially compressed, delivering a force to the opposite side of a flange on the feed rod so that it will provide a pulling force F on the other end of the feed rod acting as output element 38 in connection with the wedge or other feed element of the associated tool (see FIGS. 1 and 2), the force F comprising the feed force in both instances.

FIG. 4 also illustrates a locking cylinder or mechanism 72 (pneumatic or hydraulic) which can engage a locking notch 74 in the feed rod. If the system is placed in a neutral position (both spring sets relaxed) then this mechanism 72 can lock in the notch 74 which will lock the entire feed system. When locked, neither set of springs are used and the motion of the servomotor 30 will result in direct motion of the feed rod with no control of feed force. This feature mimics the behavior of older honing machine feed systems and is still useful for some honing applications.

Figure 5:
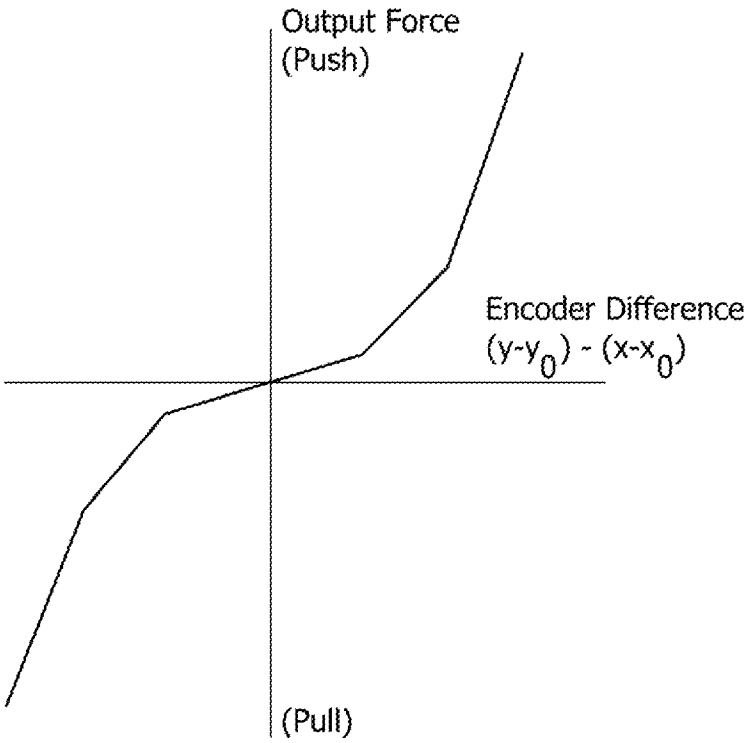
FIG. 5 is a graphical representation showing a relationship between encoder difference and output force for the motion control system of FIGS. 3 and 4.
Figure 6:
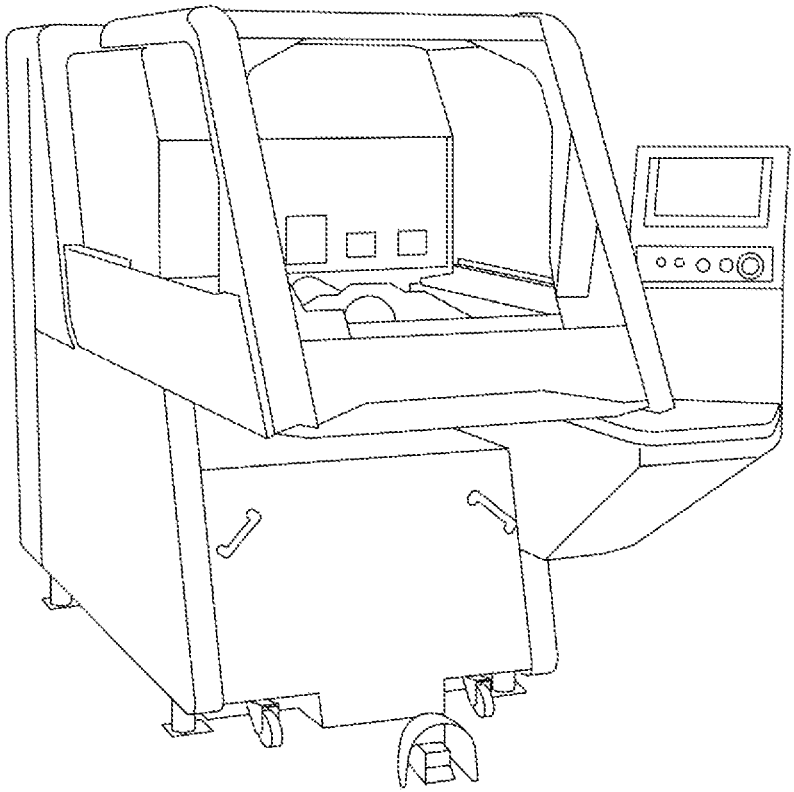
FIG. 6 is a perspective view of a representative bore finish machine incorporating the invention, showing a machine controller operable to perform control aspects of the invention.
Figure 7:
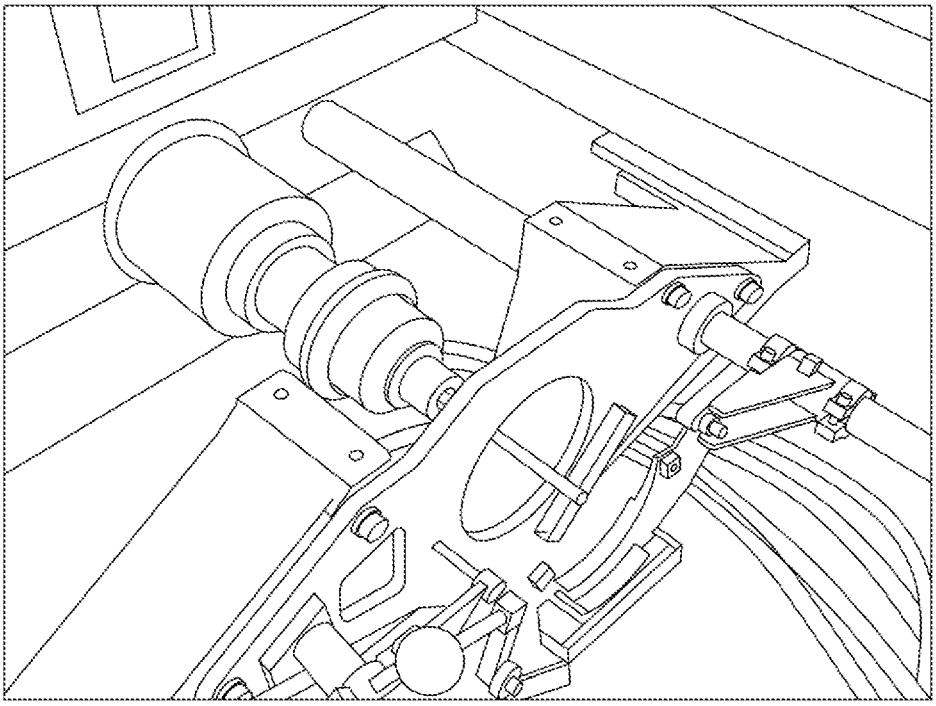
FIG. 7 is a perspective view of aspects of the machine of FIG. 6, including a rotary spindle carrying a tool holder on which is mounted a representative bore finishing tool which is a honing tool, along with associated workpiece holding apparatus of the machine.
Figure 8:
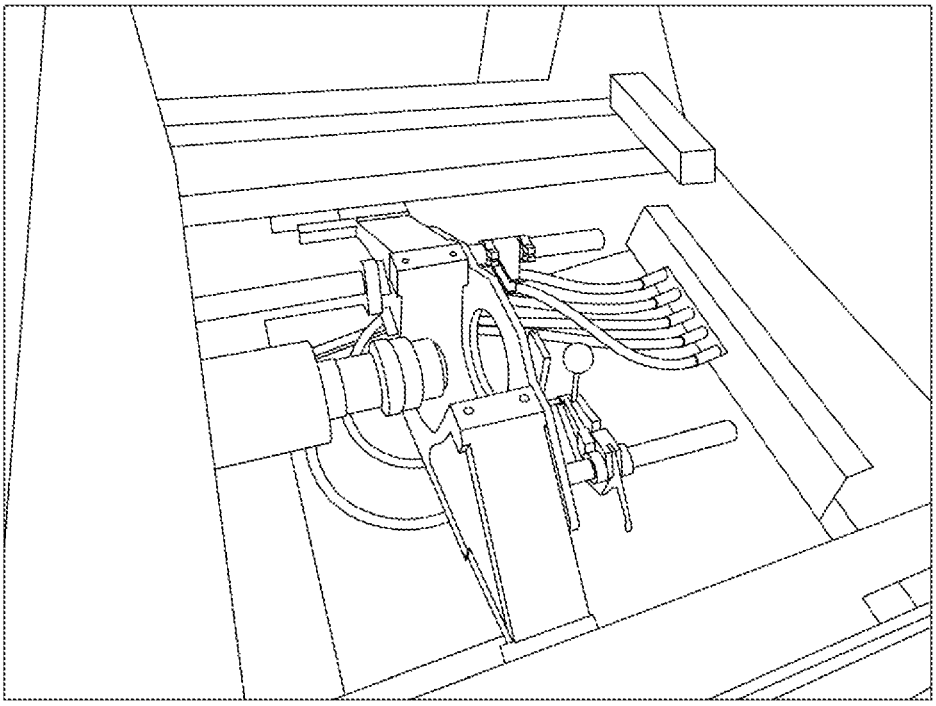
FIG. 8 is another perspective view of the machine, showing the spindle and tool holder.

The spring sets shown in FIGS. 3 and 4 employ springs of various strengths in series to create a non-linear (or piece-wise linear) relationship between the measured difference in encoder positions and the force being applied. FIG. 5 is a graph showing this relationship between encoder difference and output force.

This relationship between the encoder difference and the feed force allows the honing or other bore finishing feed system to produce a very wide range of feed forces and yet have very precise control of the lower levels of feed force. This is necessary for small tool applications where very light feed forces must be applied with precision.

As an alternative to using sets of various-sized springs, a non-linear spring could be designed and employed as elastic biasing element 32. A well-known way to achieve that is with a coil spring wound to have a continuously varying pitch. A special spring of that type could be produced to give nearly the same curve as shown as shown in FIG. 5. and hence the same benefit.

For the particular embodiment of a honing machine feed system, this above described apparatus and system can maintain the feed force very closely to the desired feed force set by the system or input by the operator. In many applications, closer control of feed force improves the bore size control of the honing operation and optimizes the life and performance of the abrasive element or honing stone.

In light of all the foregoing, it should thus be apparent to those skilled in the art that there has been shown and described an apparatus, system, and method using an elastic biasing element in combination with an encoder arrangement for precise control of force or torque applied to a moving object, namely, for controlling feed force of a bore finishing tool such as a honing tool. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A feed system for a feeding and applying a feed force to an abrasive element of a bore finishing tool in a lateral direction relative to an axis of rotation thereof, comprising:

a drive element supported for movement in a first direction and an opposite second direction and a drive apparatus connected to the drive element and controllably operable to move the drive element in the first direction and the opposite second direction within a predetermined range for generating the feed force;

at least one elastic biasing element having a first end and a second end, the first end disposed in predetermined relation to the drive element so as to be displaced by the movement thereof to cause the at least one biasing element to elastically store a quantity of energy proportional to the displacement and representative of the feed force, and the second end being disposed in predetermined relation to an output element disposed to move generally axially in cooperation with a feed element of the bore finishing tool when the output element is positioned to bear thereagainst, to transfer and apply the feed force laterally to the abrasive element and to displace jointly with the output element responsive to changes in the applied force; and a first sensor positioned and operable to measure a value representative of the displacement of the second end of the biasing element and output a signal representative thereof, a second sensor positioned and operable to measure a value representative of the displacement of the first end of the biasing element and output a signal representative thereof, and a processor connected to the first sensor and to the second sensor to receive the signals outputted thereby and configured to determine a responsive value for moving the drive element of the drive apparatus to apply a selected feed force.

2. The feed system of claim 1, wherein the processor is connected in operative control of the drive apparatus.

3. The feed system of claim 1, wherein the drive apparatus comprises a servomotor and apparatus to translate rotary motion thereof to linear motion.

4. The feed system of claim 1 wherein the first sensor and the second sensor comprise encoders, respectively.

5. The feed system of claim 1, wherein the second sensor comprises an encoder incorporated into the drive apparatus.

6. The feed system of claim 1, comprising at least two of the elastic biasing elements.

7. The feed system of claim 6, wherein the biasing elements have different spring constant values.

8. The feed system of claim 1, wherein the at least one elastic biasing element comprises multiple biasing elements arranged in sets.

9. The feed system of claim 1, wherein the at least one biasing element comprises a spring.

10. The feed system of claim 1, wherein the at least one elastic biasing element is selected from a group comprising at least one elastically compressible biasing element, at least one elastically tensionable biasing element, and a combination of at least one elastically compressible biasing element and at least one elastically tensionable biasing element.

11. The feed system of claim 10, wherein the at least one elastic biasing element comprises at least one biasing element that has an elasticity property variable as a function of the displacement of one or both of the ends thereof.

12. The feed system of claim 11, wherein the at least one elastic biasing element comprises at least one variable pitch spring.

13. The feed system of claim 1, further comprising a locking mechanism positioned and operable to lock the feed system such that the displacement of the first end of the biasing element will directly move the output element to apply the feed force.

14. The feed system of claim 1, wherein the drive apparatus comprises a linear drive.

15. The feed system of claim 14, wherein the linear drive comprises a fluid cylinder.

16. The feed system of claim 14, wherein the linear drive comprises a linear motor.

17. The feed system of claim 1, wherein the selected feed force is controlled at least in part using a function based on at least one variable selected from a group consisting of at least time and position.

18. A bore finishing tool comprising:

a feed system for a feeding and applying a feed force to an abrasive element of the bore finishing tool in a lateral direction relative to an axis of rotation thereof, the feed system comprising:

a drive element supported for movement in a first direction and an opposite second direction and a drive apparatus connected to the drive element and controllably operable to move the drive element in the first direction and the opposite second direction within a predetermined range for generating the feed force;

at least one elastic biasing element having a first end and a second end, the first end disposed in predetermined relation to the drive element so as to be displaced by the movement thereof to cause the at least one biasing element to elastically store a quantity of energy proportional to the displacement and representative of the feed force, and the second end being disposed in predetermined relation to an output element disposed to move generally axially in cooperation with a feed element of the bore finishing tool when the output element is positioned to bear thereagainst, to transfer and apply the feed force laterally to the abrasive element and to displace jointly with the output element responsive to changes in the applied force; and a first sensor positioned and operable to measure a value representative of the displacement of the second end of the biasing element and output a signal representative thereof, a second sensor positioned and operable to measure a value representative of the displacement of the first end of the biasing element and output a signal representative thereof, and a processor connected to the first sensor and to the second sensor to receive the signals outputted thereby and configured to determine a responsive value for moving the drive element of the drive apparatus to apply a selected feed force.

19. A method of controlling a feed force applied to an abrasive element of a bore finishing tool laterally relative to an axis of rotation of the tool, comprising steps of:

providing a drive apparatus controllably operable to move a drive element in a first direction and an opposite second direction within a predetermined range;

providing an elastic biasing element having a first end and a second end, the first end disposed in predetermined relation to the drive element so as to be displaced by the movement thereof to cause the biasing element to elastically store a quantity of energy proportional to the displacement and representative of the feed force, and the second end being disposed in predetermined relation to an output element disposed to move generally axially in cooperation with an element of the bore finishing tool to transfer and apply the feed force laterally to the abrasive element and to transfer changes in the applied force from the abrasive element to the second end of the biasing element so as to cause displacement thereof representative of the changes; and during rotation of the tool in a bore with the abrasive element in contact with a surface bounding the bore, measuring positions of the output element or the second end of the biasing element and responsively determining displacements of the second end of the biasing element, and controlling the drive apparatus to move the drive element as required to variably displace the first end of the biasing element responsive to changes in the applied feed force as represented by the displacements of the second end thereof, to apply a predetermined feed force to the abrasive element.

20. The method of claim 19, wherein during the rotation of the tool in the bore, positions of the drive element or the first end of the biasing element are measured.

* * * * *